US006889681B1

(12) United States Patent
Alexander et al.

(10) Patent No.: US 6,889,681 B1
(45) Date of Patent: May 10, 2005

(54) ELECTRONIC PNEUMATIC PAINTBALL GUN

(75) Inventors: Aaron K. Alexander, Indianapolis, IN (US); Larry G. Alexander, Indianapolis, IN (US)

(73) Assignee: Akalmp, Inc., Indianapolis, IN (US)

( * ) Notice: Subject to any disclaimer, the term of this patent is extended or adjusted under 35 U.S.C. 154(b) by 0 days.

(21) Appl. No.: 09/630,109

(22) Filed: Aug. 1, 2000

(51) Int. Cl.[7] ..... F41B 11/02
(52) U.S. Cl. ..... 124/72
(58) Field of Search ..... 124/71–74, 75–77

(56) References Cited

U.S. PATENT DOCUMENTS

| | | | | |
|---|---|---|---|---|
| 2,304,320 A | | 12/1942 | Tratsch | |
| 2,554,116 A | | 5/1951 | Monner | |
| 2,568,432 A | | 9/1951 | Cook | |
| 2,594,240 A | | 4/1952 | Wells | |
| 2,634,717 A | | 4/1953 | Junkin | |
| 2,834,332 A | | 5/1958 | Guthrie | |
| 2,845,055 A | | 7/1958 | Collins et al. | |
| 2,845,805 A | | 8/1958 | Crewe | |
| 3,089,476 A | | 5/1963 | Wolverton | |
| 3,192,915 A | | 7/1965 | Norris et al. | |
| 3,662,729 A | | 5/1972 | Henderson | |
| 3,695,246 A | | 10/1972 | Filippi et al. | |
| 3,921,980 A | | 11/1975 | Artzer | |
| 4,094,294 A | | 6/1978 | Speer | |
| 4,215,867 A | | 8/1980 | Natwick | |
| 4,350,447 A | | 9/1982 | Landa | |
| 4,362,145 A | | 12/1982 | Stelcher | |
| 4,770,153 A | | 9/1988 | Edelman | |
| 4,819,609 A | | 4/1989 | Tippmann | |
| 4,899,717 A | | 2/1990 | Rutten et al. | |
| 4,936,282 A | | 6/1990 | Dobbins et al. | |
| 5,228,427 A | | 7/1993 | Gardner, Jr. | |
| 5,280,778 A | | 1/1994 | Kotsiopoulos | |
| 5,285,765 A | | 2/1994 | Lee | |
| 5,333,594 A | | 8/1994 | Robinson | |
| 5,373,833 A | * | 12/1994 | D'Andrade | 124/69 |
| 5,383,442 A | | 1/1995 | Tippmann | |
| 5,413,083 A | | 5/1995 | Jones | |
| 5,462,042 A | * | 10/1995 | Greenwell | 124/76 |
| 5,494,024 A | * | 2/1996 | Scott | 124/73 |
| 5,572,982 A | * | 11/1996 | Williams | 124/74 |
| 5,704,342 A | | 1/1998 | Gibson et al. | |
| 5,727,538 A | | 3/1998 | Ellis | |
| 5,878,736 A | | 3/1999 | Lotuaco, III | |
| 5,881,707 A | | 3/1999 | Gardner, Jr. | |
| 5,890,479 A | * | 4/1999 | Morin | 124/31 |
| 5,950,611 A | | 9/1999 | Lopez et al. | |
| 5,954,042 A | | 9/1999 | Harvey | |
| 5,967,133 A | | 10/1999 | Gardner, Jr. | |
| 6,003,504 A | | 12/1999 | Rice et al. | |
| 6,035,843 A | | 3/2000 | Smith et al. | |
| 6,065,460 A | | 5/2000 | Lotuaco, III | |
| 6,273,080 B1 | | 8/2001 | Sullivan, Jr. | |
| 6,347,622 B1 | | 2/2002 | Hsueh | |
| 6,349,711 B1 | | 2/2002 | Gardner, Jr. et al. | |
| 6,405,722 B2 | | 6/2002 | Colby | |
| 2002/0046747 A1 | | 4/2002 | Colby | |

FOREIGN PATENT DOCUMENTS

| | | | | |
|---|---|---|---|---|
| GB | 2056635 A | * | 3/1981 | F41B/11/00 |
| GB | 2 146 416 A | | 4/1985 | |
| WO | WO 97/26498 | | 7/1997 | |

* cited by examiner

*Primary Examiner*—Teri P. Luu
*Assistant Examiner*—Troy Chambers
(74) *Attorney, Agent, or Firm*—Woodard, Emhardt, Moriarty McNett & Henry LLP

(57) ABSTRACT

An improved electronic pneumatic paintball gun, with an improved, simplified design incorporating an improved pneumatic hammer, electronic control circuit, pressure regulator, bolt design and cocking system for utilization in paintball guns or related devices. This paintball gun eliminates complex mechanical systems thus providing a consistent operation with low maintenance. The paintball gun utilizes low pressure to minimize damage to paint balls when fired and to the paintball gun's internal parts, plus increase the effective number of shots per tank.

19 Claims, 13 Drawing Sheets

ELECTRONIC PNEUMATIC PAINTBALL GUN

TECHNICAL FIELD OF THE INVENTION

The present invention generally relates to marking devices and, more particularly, to an electronic pneumatic paintball game.

BACKGROUND OF THE INVENTION

The sport of paintball was developed back in the early 1980's. Paintball gun technology has developed rapidly since then, out-pacing all other paintball-related equipment. The evolution of paintball guns started with single shot pistols. Then the pump paintball gun was developed which still had to be manually re-cocked to load another paintball and set the hammer in the "ready-to-fire" position. Pump paintball guns were the standard paintball bun for a few years. Then Tippmann Pneumatics (U.S. Pat. No. 4,819,609) developed one of the first semi-automatic paintball guns. This design used air to push a spring-fired hammer back to the ready position after the gun was fired. This design is known as an open bolt blow back paintball gun because the hammer is blown back into the ready position and, since the bolt is connected to the hammer, the bolt is open allowing a ball to drop into the breech.

Just a short time after Tippmann developed the block back paintball gun, Glenn Palmer developed a closed bolt pneumatic paintball gun built using a pump paintball gun. This paintball gun used a pneumatic piston attached to a manually operated 4-way valve. After the paintball gun was fired, the trigger traveled an extra distance which activated the 4-way valve, shuttling air to the back side of the pneumatic piston. The piston then pushed the bolt and hammer back allowing another paintball to fall into the breech. Then the trigger was released and the 4-way valve shuttled air back to the front side of the piston, pulling the bolt closed and sealing the paintball into the breech, leaving the paintball gun ready to fire again.

It was found that a paintball fired from a closed bolt pneumatic paintball gun had a longer range and better accuracy than a paintball fired from an open bolt blow back paintball gun. The only problem with a closed bolt paintball gun was its complexity, which required a higher price tag.

Recently, electronics have been added to the closed bolt pneumatic guns in an attempt to simplify their mechanical complexity. Instead, electronics have complicated the situation further because many of the paintball guns upon which the electronic guns are based had poor designs that are not suitable for electronic automation. Current electronic paintball guns come in several different designs. Four out of five of them are open bolt designs, but they all are inadequate for the job, usually being overly complicated with many small and delicate parts with poor construction.

The electronic guns use electric solenoid valves which are pressure sensitive and easily damaged from the high air pressures often used in prior art paintball guns. Also the use of the unregulated air to move the bolt back and forth creates a problem when the ball gets caught by the bolt. The bolt can cut the ball in half causing the gun to stop working. Some electronic guns have hoses and delicate parts on the outside of the gun that can be hit and damaged by a paintball. But for the most part the prior art electronic guns use high end electronics and low end guns to try to make a high grade paintball gun.

The present invention corrects this problem with a design specifically developed from the ground up to be an electronic closed bolt pneumatic paintball gun and more particularly to be an improved electronic pneumatic paintball gun with an improved pneumatic hammer, electronic control circuit, pneumatics pressure regulator, bolt design and cocking system. All parts of the gun are built around a cartridge design for quick replacement of a malfunctioning part. This design combines electronics, reliable design functions, ease of maintenance, and simple construction.

SUMMARY OF THE INVENTION

The present invention provides an improved paintball gun which operates at a low internal pressure with minimal distortion and damage to the paintball when fired and increases the effective number of shots peak tank. It is reliable, has a reduced number of parts and is easily maintained. This is accomplished with the use of a simplified pneumatics pressure regulator, hammer system, ram, bolt and electronics. These and other features and advantages of the invention will be more readily apparent upon reading the following description of a preferred embodiment of the invention and upon reference to the accompanying drawings.

The present preferred embodiment paintball gun utilizes the technology of two existing patents. One is U.S. Pat. No. 5,791,328 (Aaron K. Alexander) which is a paintball gun valve that permits the paintball gun to fire a paintball with the use of air pressure that is much lower than any other paintball gun in use today and to increase the effective number of shots per tank by a factor of 2. All other valves require the use of an average of 300 psi or higher to work. This valve permits the gun to operate normally at 180 psi though, in testing, guns have been operated as low as 100 psi and still maintained the correct velocity of 300 fps on the ball.

The preferred embodiment also utilizes technology from U.S. Pat. No. 5,904,133 (Aaron K. Alexander & Larry G. Alexander). This bolt-on chamber was designed to install on existing guns to help lower the operating pressure by increasing the volume of air stored in the valve chamber. It was intended to be used in conjunction with the valve in the patent previously referenced. The present gun is designed to run at low operating pressure without the use of such a bolt-on chamber, but adding it to the end of the valve chamber will in turn lower the operating pressure even further.

The current improved paintball gun design starts with the use of a new paintball gun body design. The main gun body design, in conjunction with the cartridge designs, is a major advance in paintball gun design. The design changes allow the body of the gun to be extruded to shape (in aluminum, for example) with the outside shape and three internal bores, whereas most prior art guns require that the internal bores of the gun be machined into the gun. This greatly lowers the cost of the gun body. Additionally, most of the major parts of the present invention that would be bolt-on parts for prior art guns are machined into the gun body, making the gun much stronger and more durable than previous gun designs.

One of the major design improvements of the present paintball gun design is that the gun's overall design is built around a cartridge system for ease of maintenance. Even though each component part can be maintained individually in an ideal environment, this paintball gun is designed to be repaired quickly in a tournament situation by replacing only the affected cartridge without having to completely tear the gun down and re-tune the gun once reassembled. This allows the player to get back onto the paintball field quickly.

Having the design of the gun based around a cartridge system for replacement purposes also allows for another major design change. All prior art guns required the complete disassembly of the gun to access the internal parts of the gun. The present preferred design, with cartridges and a tubular structure, allows all internal components to be removed from the gun from both ends without removal of the grip, which has to be done on every prior art gun. The grip frame of the present invention has to be removed only to replace the solenoid valves and the circuit board, which should rarely be necessary.

The current design uses a new pressure regulator that lowers the already low input pressure into the gun so that the solenoid valves are not damaged by high air pressure. The regulator's design has fewer parts than previous regulator designs, giving it a much simpler construction and ease of maintenance.

There are two hammer systems designed to work with the present paintball gun to open the valve and release air from the valve to fire the paintball. On prior art pneumatic hammers systems, the hammer was attached to the front of the shaft of a pneumatic cylinder, commonly referred to as a pneumatic ram, which pushed the hammer against the valve to open it. The prior art systems were longer, took up more space, were fragile, and had a larger number of parts than the present invention. The two hammer systems used in this paintball gun use a hammer system where the hammer and the pneumatic ram have been combined into one piece, eliminating the long length and large size of the prior art systems and further simplifying the pneumatic hammer.

The pneumatic hammers of the present invention also use a sliding front u-cup, which reduces the friction below that achieved by prior art rams that use a stationary seal, which requires a highly polished smooth surface. The sliding u-cup removes the need for polishing and grinding the shaft of the ram, as done on all prior art pneumatic hammer systems and simplifies construction of the hammer.

The hammer systems embodiments disclosed hereinbelow are designed around the cartridge design and can be fitted to the gun without changing the settings of the electronics. The hammer cartridges have flanges on them that shoulder against the gun body, setting the hammer to a specific distance from the valve every time they are installed.

The two hammer systems used in the gun's design are very similar to each other. The first, and preferred, system uses air to push the hammer back against a spring and hold it there. When the air is released, the hammer travels forward under spring tension, hitting the valve and causing it to release air to fire the paintball. This system needs air in only one direction which in turn has several advantages over the second system of the present invention. This hammer uses less air because it needs air in only one direction. It requires fewer parts to operate, it needs only 3-way solenoid valve instead of a 4-way solenoid valve like the second system. There are fewer seals to wear and cause drag. Using a spring loaded hammer and air pressure to return the hammer to its ready to fire position allows for a much lower pneumatics pressure than if the hammer was air operated in both directions. This lower pressure required for the hammer system also lowers the pressure that the bolt uses, which in turn means that the bolt, when encountering a ball that did not load completely, will stop against the ball and not break it. This system has been tested at pressures as low as 30 psi, at which point the gun still functioned properly. This hammer design is very simple and rugged. It retains the slidable front u-cup. This hammer system uses a spring loaded piston and air on one side to draw a vacuum on the opposite side. In the current version, this hammer does draw a vacuum but is not harnessed to do work, but instead, opens the valve to fire the paintball. This hammer version uses less air than the other version and gives better consistency during high rates of fire.

The second system is an air-operated spring assist hammer system. This systems works well but requires more parts and more air. The second hammer design also uses air to operate the hammer; but in both directions this time. It provides a stronger striking force by adding spring tension behind the hammer. This air-operated spring assist hammer system provides a stronger force to open valves that require a stronger opening force, due to the pressure behind the valve because of a larger surface area of the valve. This hammer will use more air than the first hammer, due to the use of air on both sides of the hammer. This hammer retains the slidable front u-cup.

The pneumatic cylinder used to actuate the bolt back and forth, commonly called a ram in paintball, has been simplified. The ram's outer housing is referred to as the ram tube. On the end oft he ram's shaft is a part called an h-tube. The bolt's retention pin locks into the h-tube so the ram can push the bolt back and forth as the gun is actuated. The two solenoids used to actuate the gun are off-the-shelf valves with a modification so they work wit this paintball gun. Most electronic guns use standard off the shelf valves but then build complicated manifolds or use small air lines to run the air to the places it is needed. The solenoid valves chosen for the preferred embodiment gun require only a small modification to the valve body and they fit in the best position under the gun, inside a cavity in the body. That position on the body works best as they actuate each system without having complex manifolds to direct the air to other locations. They sit directly under each component they are meant to actuate. The valves themselves lie flat against the gun body located on raised bosses milled into the body, which reduces the overall height of the gun. This position is also directly over the grip frame, keeping the paintball gun's weight centered over the hand and not unbalancing the gun. Regulated air is supplied to the two solenoid valves through an air passageway which runs down the middle of the gun between the two lower bores of the gun. The air passage is connected to the pneumatic reservoir by a cross drilled air passage into the side of the gun. Most prior art guns have to run external air lines which are easily damaged or torn off completely, to achieve the same thing.

The bolt used in the present paintball gun is a very distinct design over that of the bolt used on all prior art guns. All prior art bolts have an inlet hole that is positioned 90 degrees with respect to the outlet hole. They also try to squeeze the air through multiple small holes or release it through one big straight hole to make the bolt more effective. All of this only reduces the effectiveness of the bolt. The new bolt of the present invention has an inlet hole slanted 30 degrees to the outlet hole. The slant of the inlet hole reduces the amount of energy the air looses as it changes direction. The transition between the two holes is curved to allow smooth air flow between the inlet and outlet holes. The outlet hole on this bolt is also a cone shape. The cone shape keeps the air contained and focuses the air forward. The air expands evenly along the cone shape. The prior art bolts allow the air to expand all at once and exit the bolt as one solid slug of air. The present bolt design when used in the same gun as the prior art bolts, increases the velocity 30 to 70 fps higher than the prior art bolt.

The bolt is held in the gun by a new retaining system. Most bolts are held in the gun by simple pins that wear into the parts being held, necessitating the replacement of those parts on a routine basis. The system used in the present paintball gun allows for very quick removal and installation of the bolt for cleaning purposes. It also does not wear out the parts it is attached to.

The bolt retention system keeps the bolt located in the h-tube on the end of the ram but still allows the bolt to be removed quickly and easily. The bolt retention pin is located near the back of the bolt. It has a groove milled in it with a divot at each end of the groove. A ball bearing rides in the groove held in place by a spring. The ball bearing can only move between the two divots in the groove. A "stop" in the form of a turned down nose of a set screw keeps the ball bearing from backing out of the groove. This system allows the pin to be pulled up, but not out of the bolt. Then the bolt and pin can be slid out the back of the gun as one unit. This permits easy cleaning without having to keep track of a separate pin and bolt as in prior art paintball guns. Installing the bolt is the reverse of removal.

BRIEF DESCRIPTION OF THE DRAWINGS

FIG. 1*d* is a right side view of the gun of FIGS. 1*a–c* with bolt open to allow a ball to drop in.

REFERENCE NUMBERS IN DRAWING

Figure 1A:
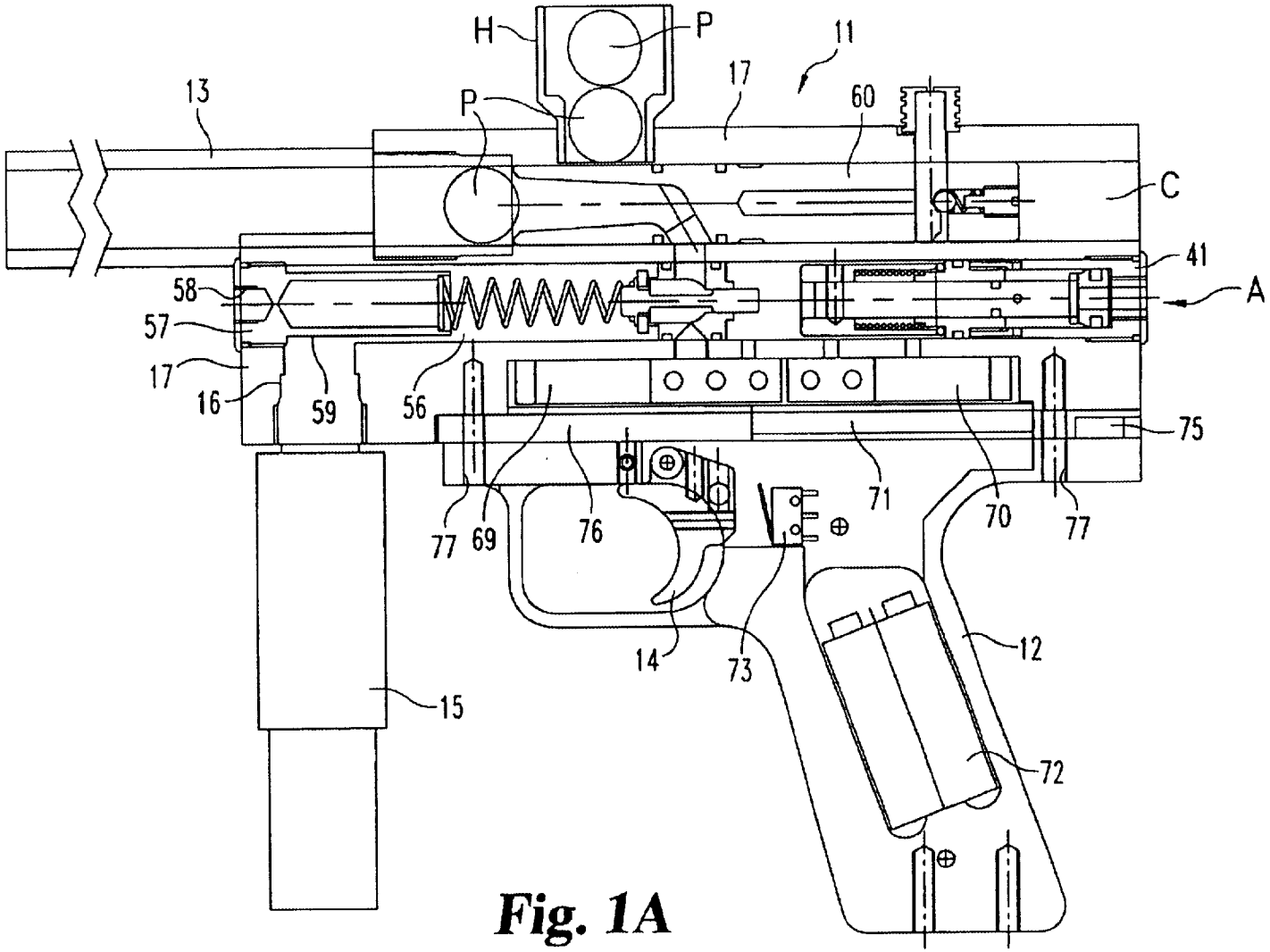
FIG. 1*a* is a left side view of a preferred embodiment gun of the present invention in the ready to fire position.

P Paintball
11 Paintball gun
12 grip frame
13 barrel
14 trigger
15 Main pressure regulator
16 vertical mount
17 receiver (gun body)
18 Threaded mounting for pneumatics regulator
19 Threaded mounting for pneumatic hammer
20 Threaded mounting for valve chamber endcap
21 o-ring, large
22 o-ring, small
23 u-cup. large (hammer & ram)
24 u-cup, small (front of hammer)
25 Pneumatics regulator
26 Pneumatics regulator body section and low pressure reservoir side
27 Regulator adjusting screw
28 Regulator seat
29 Regulator disk
30 Regulator o-ring
31 Regulator piston
32 Regulator piston spring
33 Regulator piston o-ring
34 Ram tube
35 ram endcap
36 ram rod
37 ram plate
38 Ram tube holding pin and pneumatics reg. vent hole.
39 h-tube
40 Chamber B endcap (bolt end)
41 Hammer-1
42 Hammer-2
43 Hammer tube-1
44 Hammer tube-2
45 hammer tube endcap
46 hammer plate
47 hammer bumper
48 hammer weight
49 hammer spring-1
50 hammer spring-2
51 hammer chamber vent hole
52 Valve Body
53 Valve body set screw
54 valve spring
55 Valve Stem with Seal
56 Valve chamber
57 Valve chamber A endcap
58 chamber cap screw
59 low pressure chamber
60 Bolt
61 slanted inlet hole
62 curved transition
63 conical outlet hole
64 bolt pin and knob
65 ball bearing
66 spring
67 modified set screw
68 Air passage
69 4-way Solenoid
70 3-way Solenoid
71 Electronic control circuit

72 Battery
73 Micro-switch
75 On-off switch
76 Grip frame cover plate
77 Threaded grip frame mounting hole
78 Pneumatics regulator endcap
79 High pressure channels
80 Low pressure channel
81 Ram rod channel
82 Front hammer air channel
83 Back hammer air channel
84 Air reservoir
85 Bottom air passage
86 Front air outlet
87 Bolt retention pin distal end
88 Bolt retention pin proximal end
89 Bolt retention pin groove
90 Bolt retention pin divot
91 Ram undercut surface
92 Regulator vent hole
93 Snap ring
94 Reservoir chamber
95 Ram tube end plug
96 Hammer vent hole

DETAILED DESCRIPTION OF THE PREFERRED EMBODIMENTS

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1B:
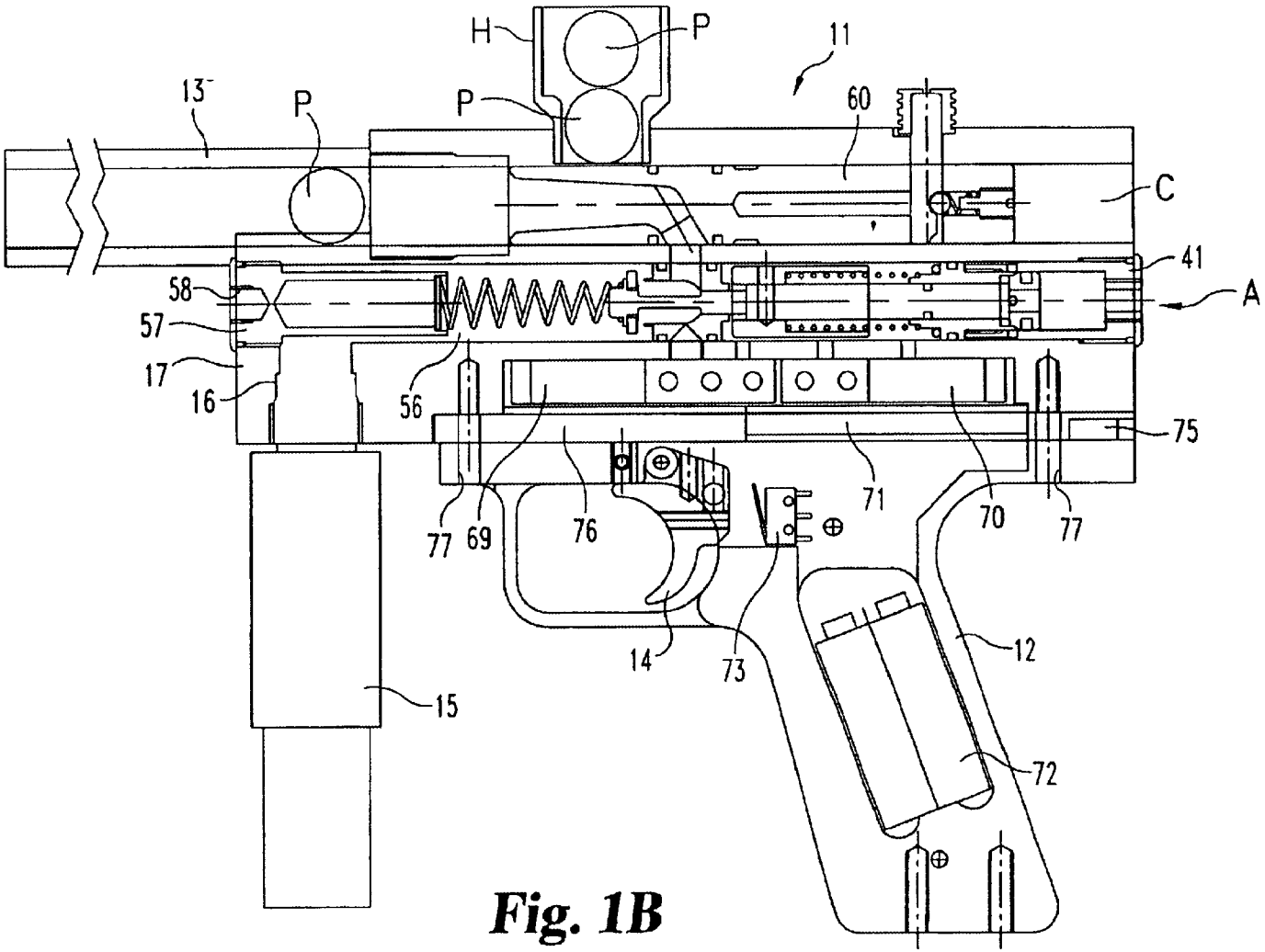
FIG. 1*b* is a left side view of the gun of FIG. 1*a* with hammer fired, valve open releasing air to propel the paintball.
Figure 1C:
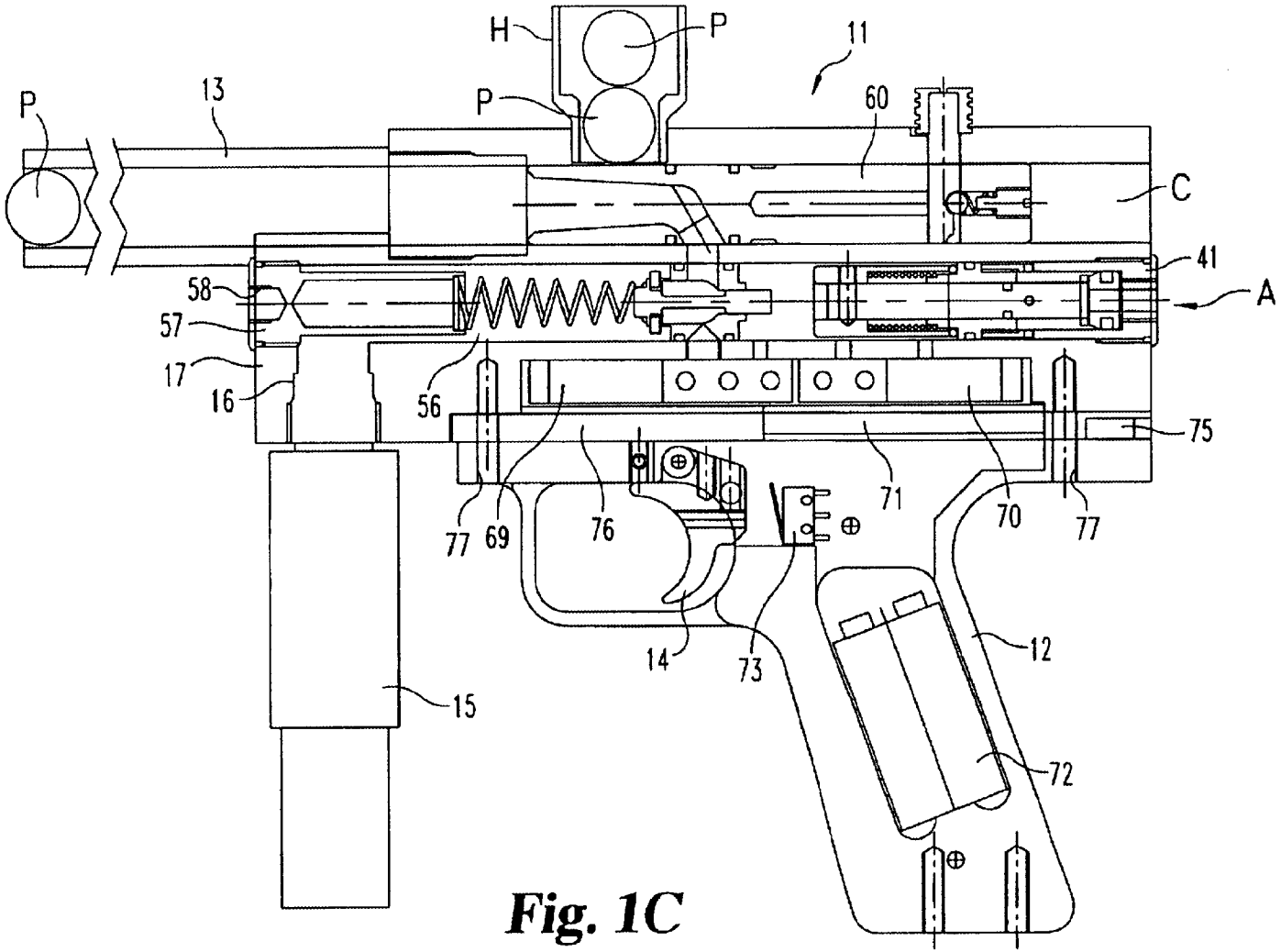
FIG. 1*c* is a left side view of the gun of FIGS. 1*a–b* with hammer returned to ready to fire position.

With reference to FIGS. 1*a–e,* there are shown left and right side elevational views of a preferred embodiment electronic paintball gun of the present invention, indicated generally at 11. Front and rear end elevational views of the paintball gun 11 are illustrated in FIGS. 2*a–b,* respectively. The paintball gun 11 includes a gun body 17, preferably formed from extruded aluminum (but which may be formed from any suitable material), which include three chambers A, B and C formed axially parallel to one another and arranged such that lines drawn connecting the axis of each of the three chambers in a plane perpendicularly intersecting the three axes form a triangle, and preferably an equilateral triangle. Arrangement of the three chambers in this manner provides significant performance benefits to the various gun functions, as described in greater detail hereinbelow.

The preferred embodiment electronic paintball gun 11 includes a grip frame 12 mounted to the body 17, the grip frame 12 including a trigger 14. The grip frame 12 is adapted to be easily gripped by a human hand, such that the index finger rests upon the trigger 14. The grip frame 12 attaches to the body 17 by means of any convenient attachment mechanism, such as bolts engaging the threaded bolt holes 77. The body 17 further includes a barrel 13 through which a paintball P is ejected when the gun 11 is fired. The paintballs P enter the gun body 17 through a paintball hopper feed tube H. The body 17 further includes a vertical mount 16 machined therein, and adapted to receive a main pressure regulator 15. A supply of compressed gas (not shown) is attached to the main pressure regulator 15, which regulates the pressure of this gas to a predetermined level (preferably approximately 180 psi). Compressed gas exiting the main pressure regulator 15 flows up through the vertical mount 16, filling the valve chamber 56 and the high pressure side of the pneumatics regulator 25.

Chamber A carries the hammer 41 and low pressure chamber 59. Chamber B carries the pneumatics regulator 25 and the ram tube 34. The chamber C carries the bolt 60.

Figure 3:
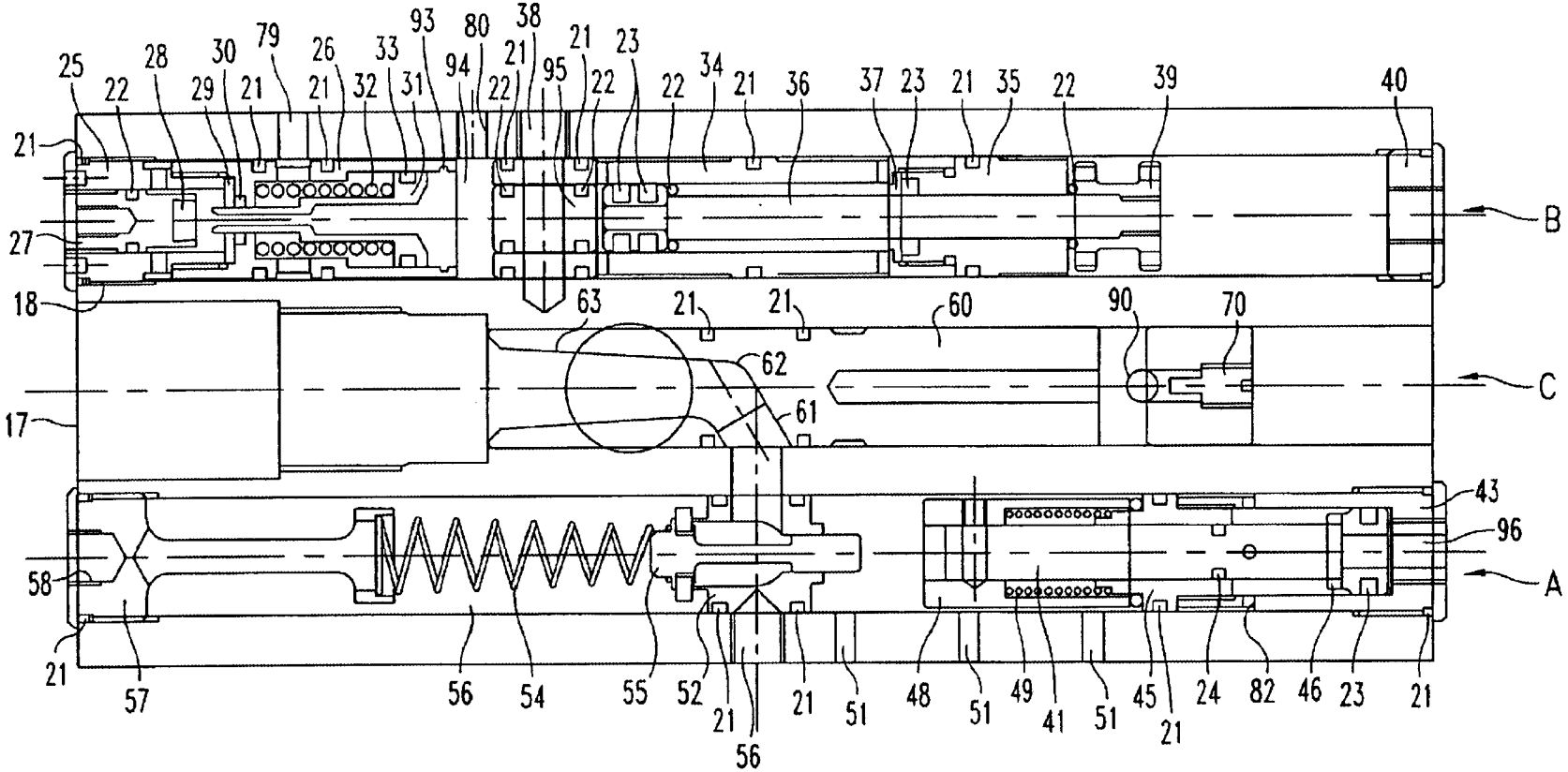
FIG. 3 is an upper schematic view of a preferred embodiment of the present invention, with parts laid out flat to show their relationship to other components in the gun and to the three chambers A, B, and C.

Referring now FIG. 3, the electronic paintball gun 11 of the present invention is illustrated schematically with all three chambers A, B and C laid side-by-side for ease of illustration and discussion. As noted hereinabove, the preferred embodiment of the electronic paintball gun 11 arranges the chambers A, B and C in a triangular relationship.

At the front end of the gun, a pneumatics pressure regulator 25 screws into the chamber B by means of interengaging threads 18 or other convenient attachment means. The pneumatic regulator 25 is shown apart from the gun 11 in FIG. 4. As with each of the subsystems of the electronic paintball gun 11, the pneumatics regulator 25 is formed as a self-contained module which may be screwed into one of the exposed ends of the chambers A, B and C, thereby allowing for simplified replacement in the field. The pneumatics regulator 25 includes an endcap 78. The pneumatics regulator 25 may be threaded into the chamber B by gripping the endcap 78. The endcap 78 forms the high pressure side of the pneumatics regulator 25, while an attached body section 26 forms the low pressure side of the pneumatics regulator 25.

Figure 1D:
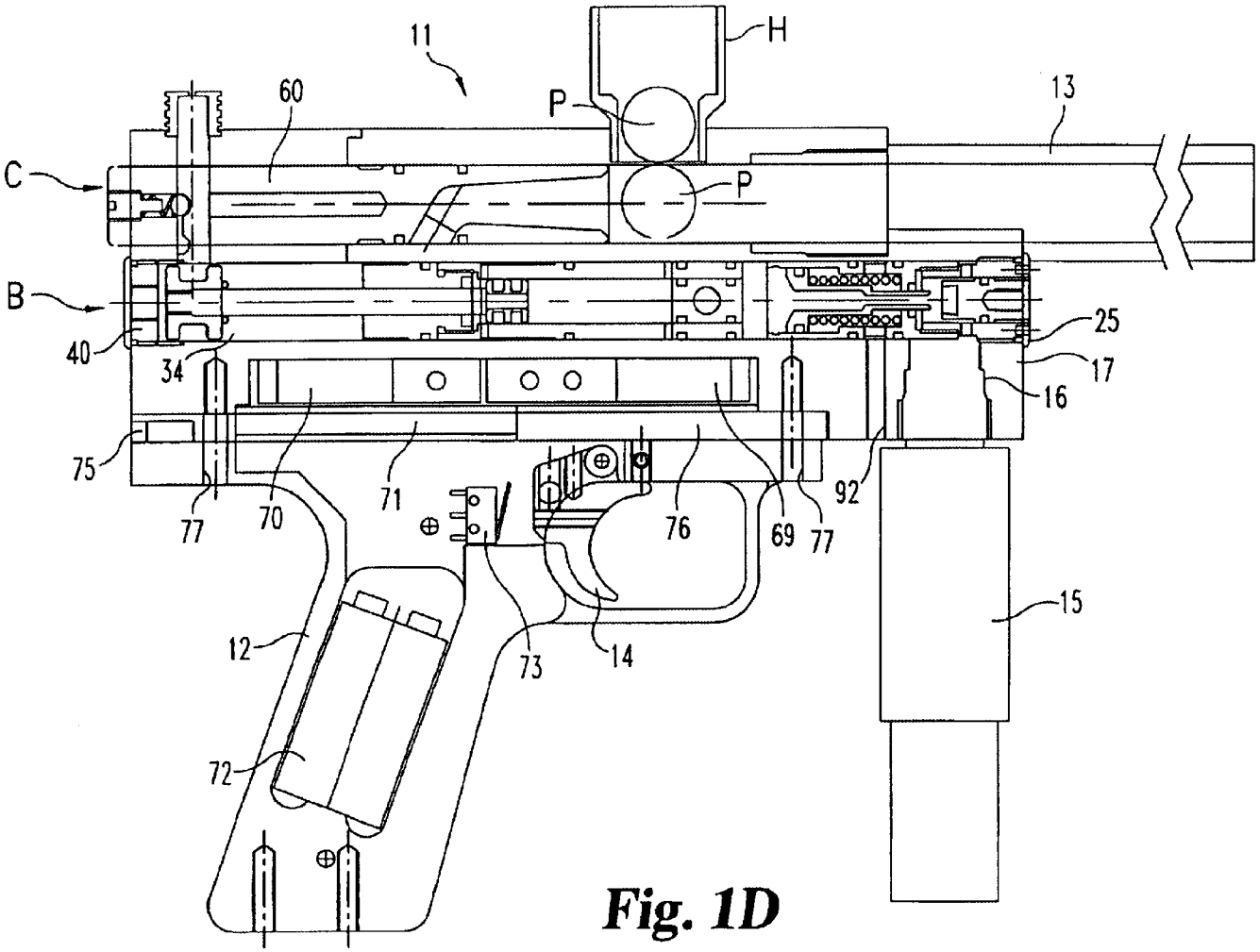
Figure 2B:
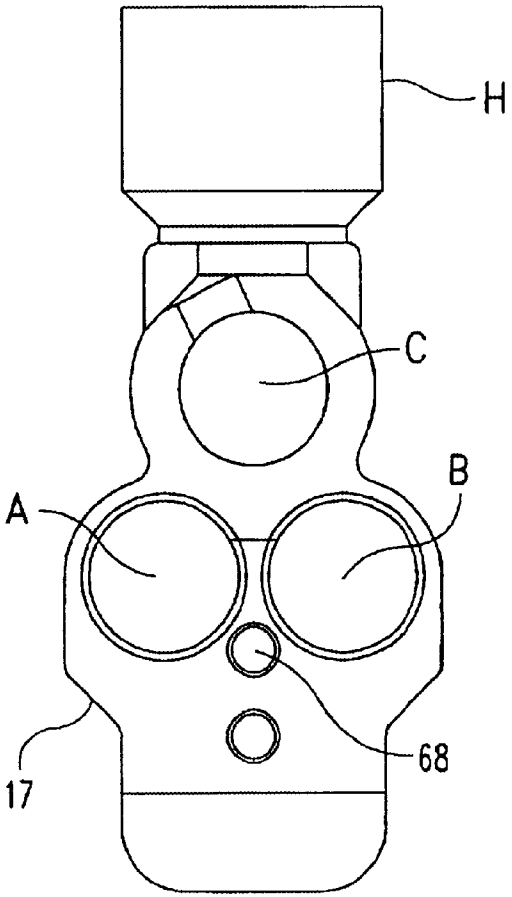
FIG. 2*b* is a back end view of a preferred embodiment gun body of the present invention and the relationship of the three chambers A, B, and C to each other.
Figure 2A:
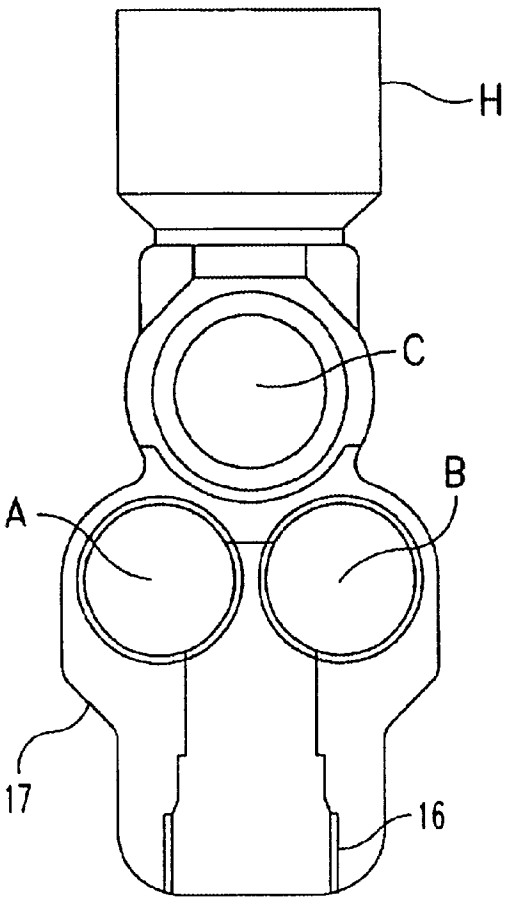
FIG. 2*a* is a front end view of a preferred embodiment gun body of the present invention and the relationship of the three chambers A, B and C to each other.
Figure 4:
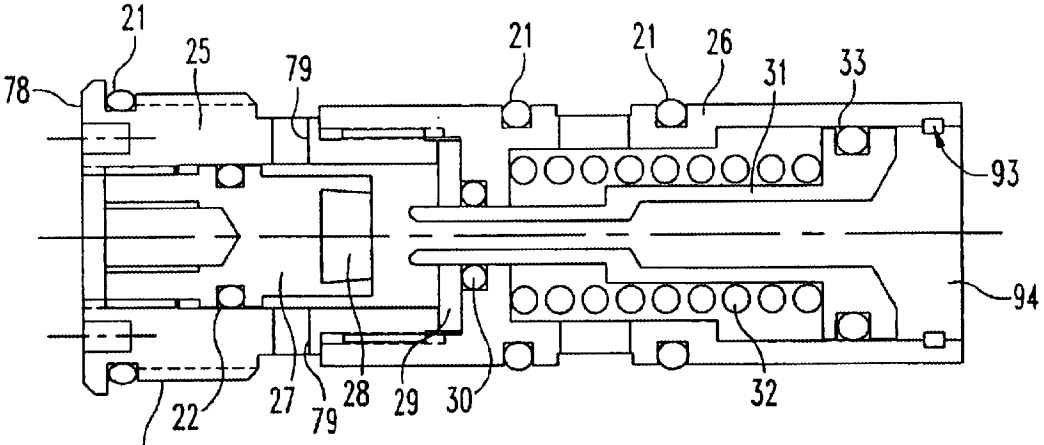
FIG. 4 is a cut away view of a preferred embodiment pneumatics pressure regulator and pneumatics air reservoir of the present invention.

As best shown in FIGS. 1*d* and 4, high pressure air from the vertical mount 16 enters the high pressure side of the pneumatics regulator 25 through channels 79 formed in the endcap 78. By use of an o-ring 21 to seal the end of the chamber B, high pressure air can be stored within the endcap 78. A regulator adjusting screw 27 and regulator seat 28 fit within the high pressure cavity formed inside the endcap 78. A cavity 79 is provided so that an Allen wrench may be used to adjust the position of the adjusting screw 27 with respect to the endcap 78. The regulator body 25 compresses a regulator disk 29 and regulator o-ring 30 as the body 25 is tightened onto the regulator body 26. Regulator piston 31, regulator piston spring 32 and regulator piston o-ring 33 are held within regulator body 26 by a snap ring 93.

The high pressure air entering through the channels 79 flows through the center of regulator piston 31 and builds up pressure within chamber 94. This pressure acts upon regulator piston 31, pushing it to the left (and thereby compressing regulator piston spring 32) until the piston 31 seats against regulator seat 28 on adjusting screw 27. This prevents further air flow through the center of regulator piston 31 until the pressure in chamber 94 is released, allowing spring 32 to push piston 31 off to the seat 28. This creates a regulated supply of air within the chamber 94 of (preferably) 80 psi. It will be appreciated by those skilled in the art that adjustment of the seat 28 position by turning the screw 27 will allow any desired air pressure to be achieved.

This low pressure air supply is used for the other pneumatics systems of the electronic paintball gun 11. The low pressure regulated air exits the pneumatics regulator 25 by means of the low pressure channel 80 (see FIG. 3).

Figure 5:
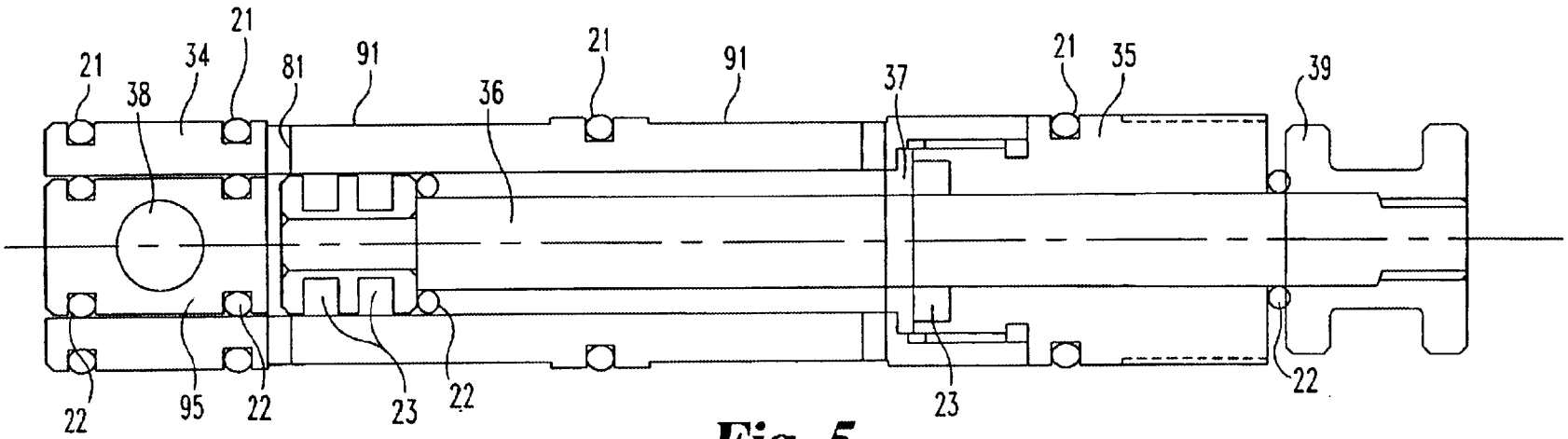
FIG. 5 is a side cross-sectional view of a preferred embodiment ram system of the present invention.

With reference now to FIGS. 3 and 5, the remainder of the chamber B is filled with the pneumatic ram, consisting of the ram tube 34, and the ram endcap 35 which preferably screws into the ram tube 34. The pneumatic ram slides back and forth within the space of chamber B during operation of the gun 11. The end of chamber B is sealed with chamber B endcap 40, which also preferably threadingly engages chamber B.

The ram endcap 35 holes a u-cup 23 and ram plate 37 in place inside the ram tube 34. A ram rod 36 slides back and forth through the center of the ram tube 34. The ram rod 36 also has two u-cups 23 on one end, facing back to back, to provide a seal between the two sides of the pneumatic cylinder thereby formed with the ram tube 34. The ram tube 34 is held in place within the gun body 17 by means of a ram tube end plug 95 and a retaining pin 38, which also acts as the vent hole for the pneumatic regulator 25.

The ram rod 36 is threadingly engaged to an h-tube 39. As discussed in greater detail hereinbelow, the h-tube 39 pulls the bold 60 back and forth during cycling of the gun 11 by use of the bolt retention pin 64 (see FIG. 9B). Air enters the left side of the ram rod 36 through undercut surfaces 91 and channels 81. The undercut surfaces 91 are formed around the outside of ram tube 34 and line up with air passages from the solenoid valve 69 (see FIG. 10). The air pressure acting upon the end of the ram rod 36 causes the ram rod 36 to slide upon u-cups 23 within the ram rod 34. This motion causes the h-tube 39 to move back and forth within the chamber B. O-rings 22 act as bumpers to keep the ram rod 36 from damaging the other components by preventing metal-to-metal contact.

Figure 6A:
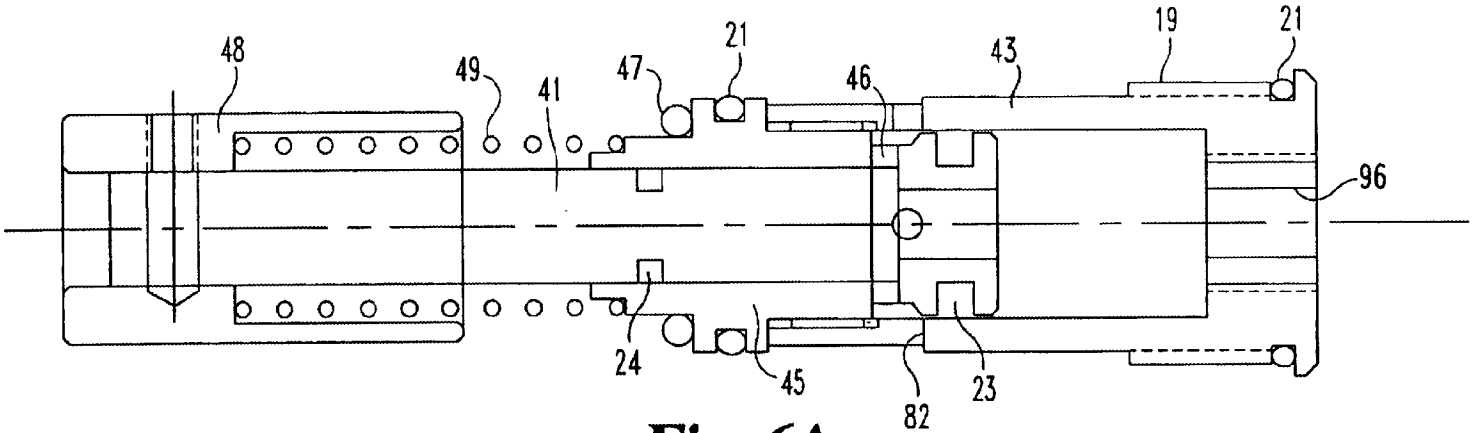
FIG. 6*a* is a cut away view of a first embodiment hammer of the present invention.

With reference now to FIGS. 3 and 6*a,* the pneumatic hammer 41 slides within a hammer tube 43 and a hammer tube endcap 45 which is preferably threadingly engaged with the hammer tube 43, which is in turn preferably threadingly engaged (by means of threads 19) to chamber A with o-ring 21 therebetween. The hammer 41 incorporates a sliding front u-cup 24 and rear u-cup 23, allowing the hammer 41 to slide within the hammer tube endcap 45 and hammer tube 43, respectively. The hammer tube 43 also houses a hammer plate 46, a hammer bumper 47 (preferably made from rubber, urethane or soft plastic), a hammer spring 49 and a hammer weight 48, which provides a surface upon which the hammer spring 49 pushes.

When the hammer 41 is at rest, air from solenoid 70 (as discussed hereinbelow) enters air passage 82 and pushes the hammer 41 and hammer weight 48 back against the hammer bumper 47, compressing the hammer spring 49 (see FIG. 3). When solenoid 70 is turned on, it releases the air from the front side of the hammer 41, causing the compressed hammer spring 49 to throw the hammer 41 forward. Forward movement of the hammer 41 pulls a vacuum on the back side of the hammer 41, which is vented by the vent hole 96. The hammer 41 stops against the hammer plate 46, which is held in place by the hammer tube endcap 45 screwed into the hammer tube 43. The sudden stopping of the hammer 41 against the hammer plate 46 transfers all of the forward momentum of the hammer 41 to the valve stem 55 of the valve body 52 (see FIG. 3). This opens the valve stem 55, once again supplying air to the front of the hammer 41, moving it back against the hammer bumper 47 and recompressing the hammer spring 49.

The use of the sliding front u-cup 24 reduces the sliding friction below that achieved by the use of a stationary seal, as in prior art designs. The prior art stationary seal requires a highly polished and smoothed surface on the hammer. Use of the sliding u-cup 24 removes the need for polishing and grinding the shaft of the hammer as is done on all prior art pneumatic hammer systems, thereby simplifying the construction of the hammer 41 of the present invention.

Figure 6B:
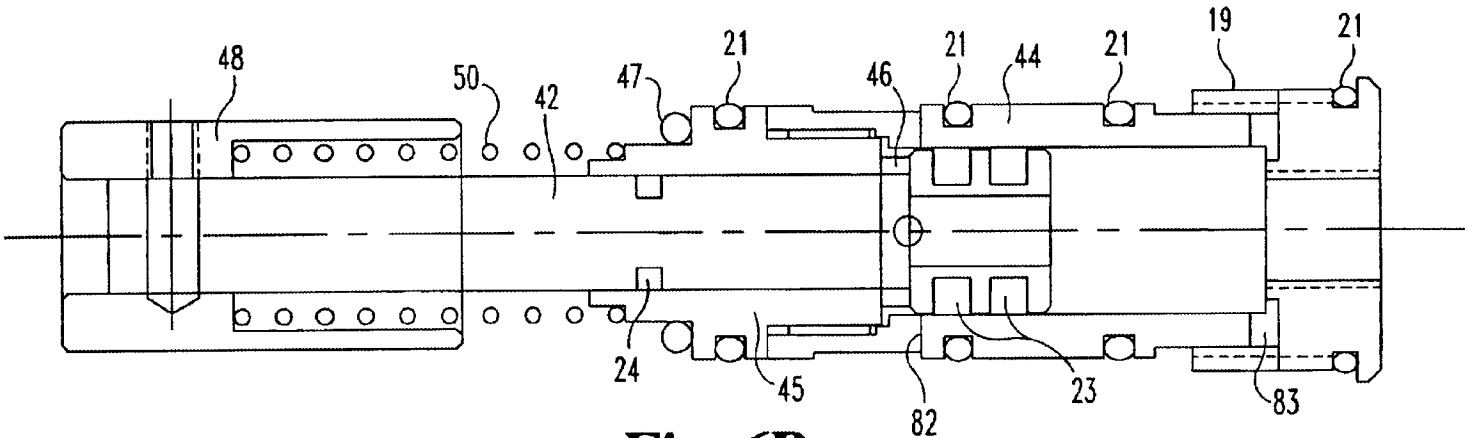
FIG. 6*b* is a cut away view of a second embodiment hammer of the present invention.

Referring now to FIG. 6*b,* a second embodiment pneumatic hammer of the present invention is illustrated. The second embodiment pneumatic hammer includes a hammer 42 that utilizes two u-cups 23 to seal both ends of the hammer 42. The hammer 42 is housed in hammer tube 44, which also houses the hammer plate 46, the hammer bumper 47 and the hammer spring 50. When the hammer 42 is at rest, air from the solenoid 70 enters the air passage 92 and pushes the hammer 42 and the hammer weight 48 back against the hammer bumper 47, thereby compressing the hammer spring 50. When the solenoid 70 is turned on, it releases air from the front side of the hammer 42 through the front hammer air channel 82, and supplies air to the back side of the hammer 42 through back hammer air channel 83 at the same time that the hammer spring 50 throws the hammer 42 forward. The hammer 42 stops against the hammer plate 46, which is held in place by the hammer tube endcap 45 preferably screwed into the hammer tube 44. This sudden stop of the hammer 42 transfers all of the forward momentum to the valve 52, thereby opening it. The solenoid 70 then releases air from the back side of the hammer 42 and again supplies air to the front side of the hammer 42, thereby moving the hammer 42 back against the hammer spring 50. As discussed hereinabove with respect to FIG. 6*a,* with use of the sliding u-cup 24 provides significant advantages over the stationary seal design used in prior art pneumatic hammers.

Figure 7:
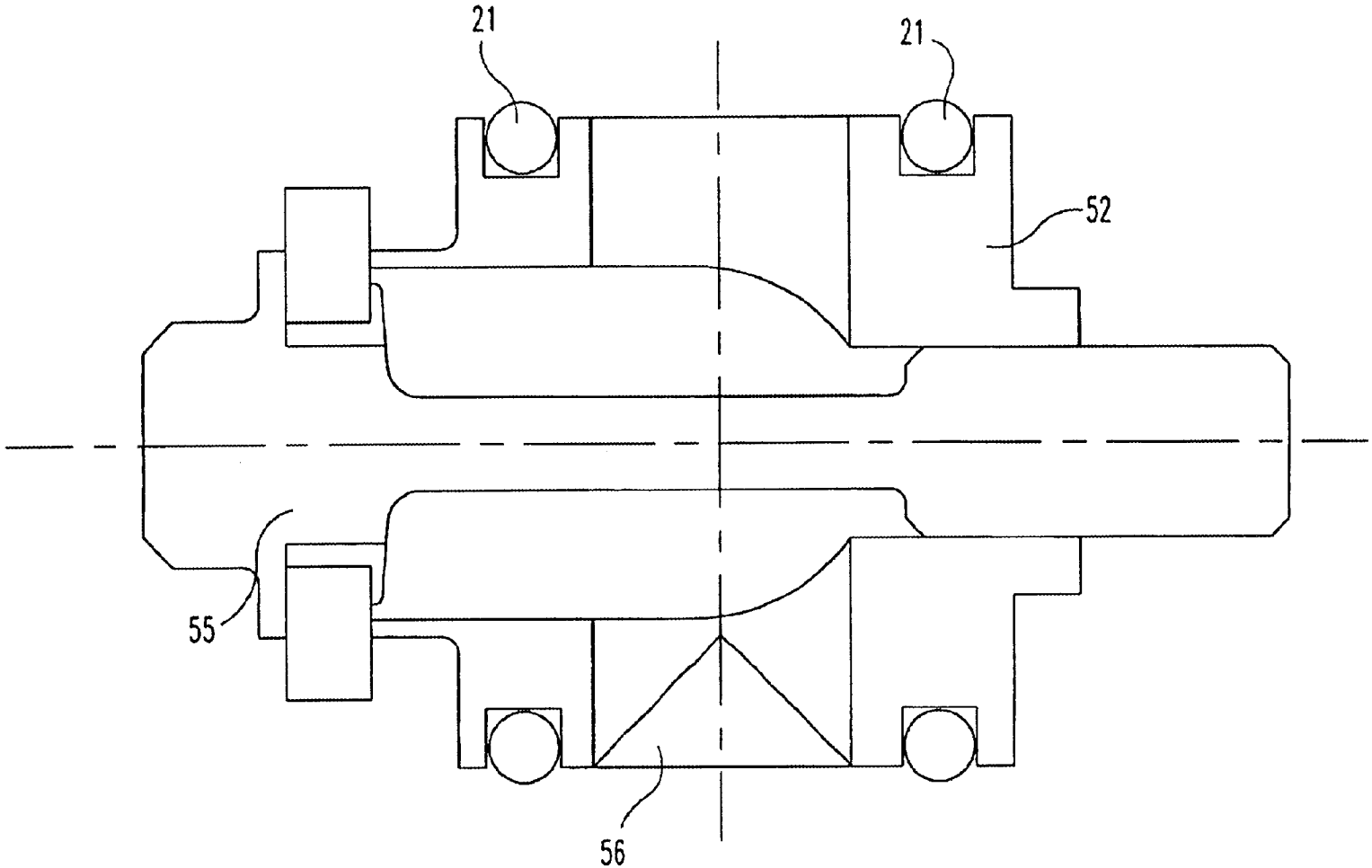
FIG. 7 is a cut away view of a preferred embodiment low pressure valve of the present invention.

Referring now to FIG. 7, there is illustrated a valve body 52 having a moveable valve stem 55 therein. The valve stem 55 is actuated by the pneumatic hammer, as described in more detail hereinabove. The valve 52, 55 is of the type described in U.S. Pat. No. 5,791,328, the specification and drawings of which are incorporated herein by reference in their entirety. As shown in FIG. 3, the valve body 52 is held in place within the chamber A by means of a valve body set screw 53, which penetrates the gun body 17. Excess air between the valve body 52 and the hammer endcap 45 is vented through vent hole 51. O-ring seals 21 seal the valve body 52 against the sides of the chamber A.

Figure 8A:
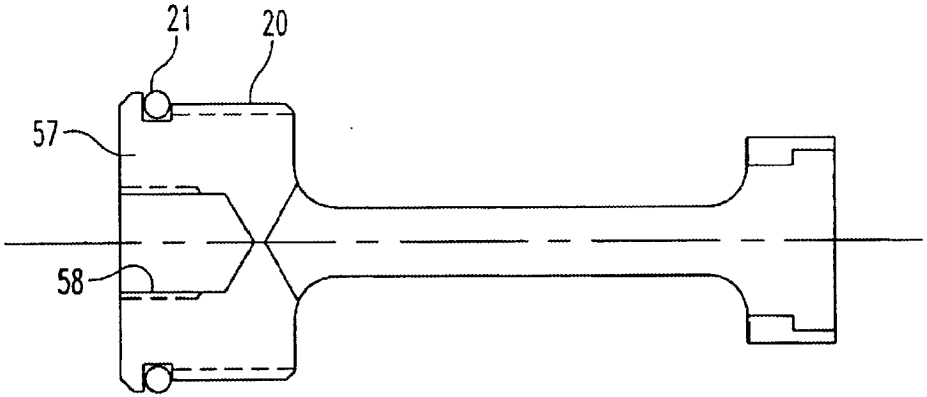
FIG. 8*a* is a cut away view of a first embodiment chamber A endcap of the present invention.

With reference to FIGS. 3 and 8*a,* the other end of chamber A is sealed by a valve chamber endcap 57 which preferably threadingly engages the chamber A by means of threaded surface 20. An o-ring 21 provides an air-tight seal. The endcap 57 preferably includes a recess 58 to allow the use of an Allen wrench to tighten the endcap 57.

The endcap 57 seals the valve chamber 56 and holds a valve spring 54 in place against the valve stem 55, thereby sealing off air from escaping through the valve body 52 until the hammer 41 strikes the valve stem 55.

Figure 8B:
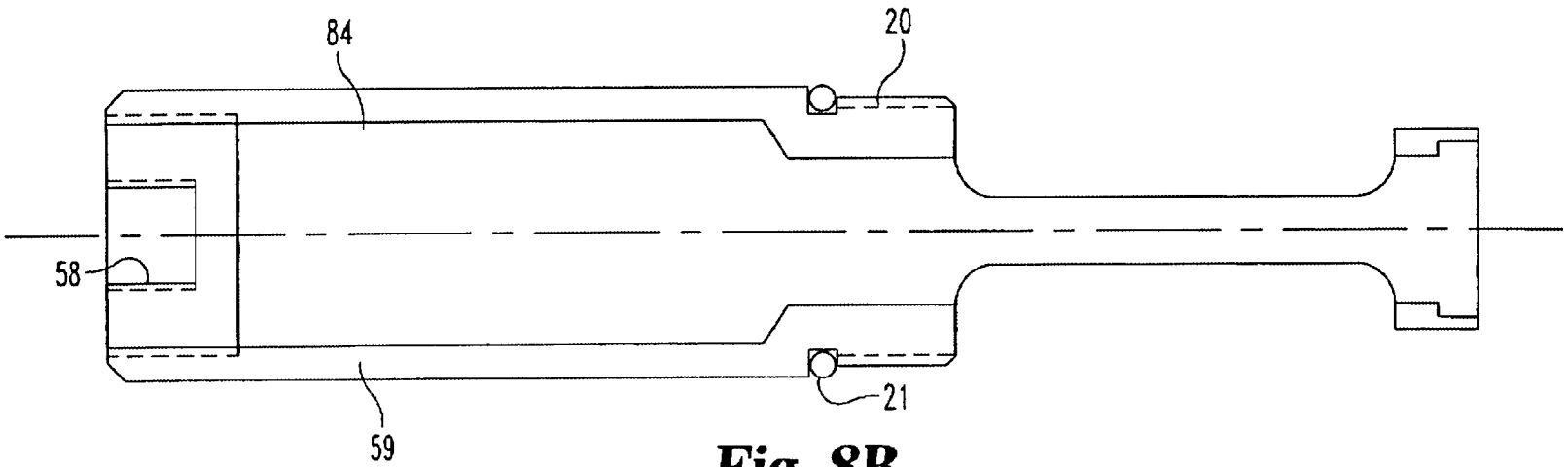
FIG. 8*b* is a cut away view of a second embodiment chamber A endcap of the present invention.

An alternative for the endcap 57 is the valve chamber endcap 59 illustrated in FIG. 8*b*. The valve chamber endcap 59 includes an extended air reservoir 84, allowing the gun 11 to store a larger volume of low pressure air and thus allowing the paintball gun 11 to shoot a paintball P at the normal velocity of 300 fps, but at a lower pressure than with the endcap 57. The use of a low pressure chamber in this fashion is explained in greater detail in U.S. Pat. No. 5,904,133, the drawings and specifications of which are incorporated herein by reference in their entirety.

Figure 9A:
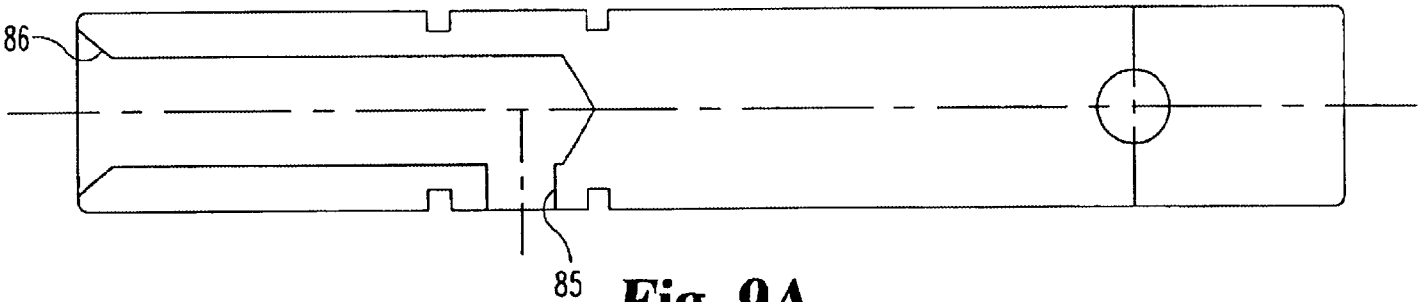
Fig. 9A (PRIOR ART)
FIG. 9*a* is a cut away view of a prior art bolt.

Referring now to FIG. 9*a,* there is illustrated a bolt from a prior art pneumatic paintball gun. Because air enters the bolt through a side passage 85 and exits the bolts through a front air outlet 86, the air is forced to execute a 90 degree turn therebetween, thereby causing turbulent flow of the air and greatly decreasing the power of the air charge.

Figure 9B:
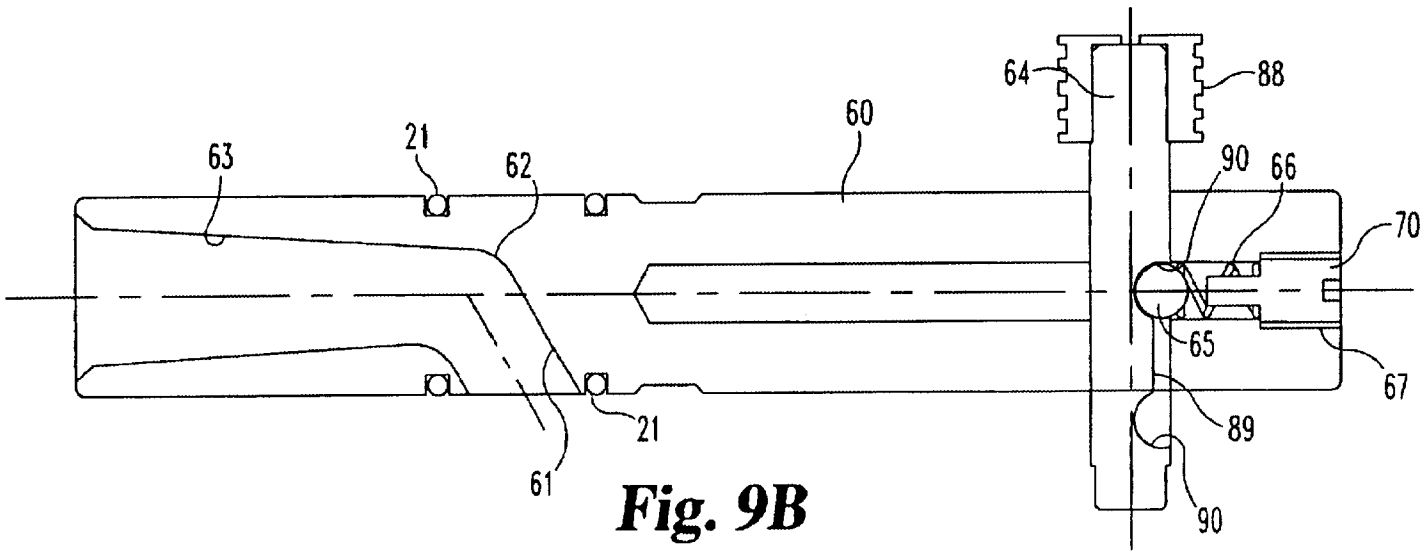
FIG. 9*b* is a cut away view of a preferred embodiment enhanced flow bolt and bolt retention system of the present invention, and a cutaway of a prior art bolt for comparison.
Figure 10:
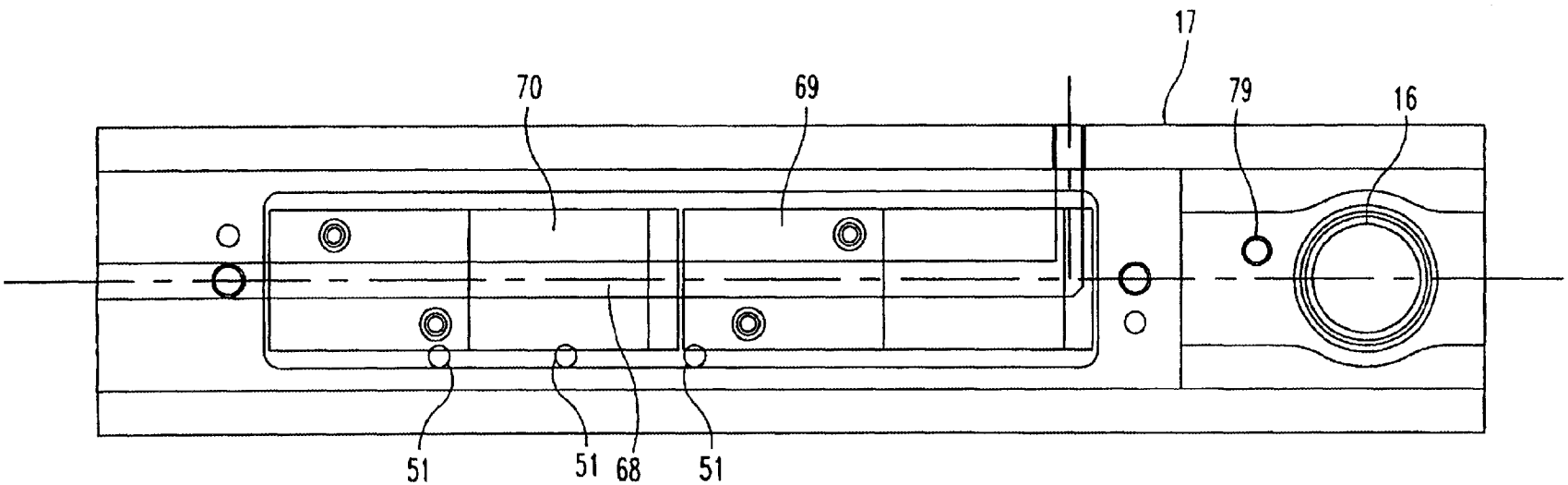
FIG. 10 is a bottom view of a preferred embodiment gun body of the present invention, showing locations of the vertical mount, solenoid valves, solenoid valve air passageway and the on-off switch.

In contrast, a bolt 60 of the present invention is illustrated in FIG. 9*b*. The bolt 60 uses a new airflow channel shape which increases performance over the prior art bolt illustrated in FIG. 9*a*. The bolt 60 has a slanted inlet hole 61 preferably tilted at an angle of between 15 and 45 degrees, and more preferably at an angle of 30 degrees with respect to a plane transverse to the longitudinal axis of the bolt 60. The bolt 60 further includes a generally conically shaped outlet path 63. A radiused section 62 provides a transition between the slanted inlet 61 and the conical outlet 63. Provision of the slanted inlet 61 helps the air transition through its approximately 60 degree change of direction with less turbulence and therefore with less loss of energy. The conical outlet 63 keeps the air contained and focuses the air forward to expand evenly in a cone shape instead of allowing the air to expand all at once as it exits the bolt, as in prior art bolts.

With reference to FIGS. 3 and 9*b,* the bolt 60 resides within the chamber C of the gun 11. The bolt 60 includes a bolt retention pin 64 extending therethrough, wherein a distal end 87 of the bolt retention pin 64 extends through a groove (not shown) joining the chambers B and C, such that the distal end 87 is captured by the h-tube 39 of the pneumatic ram. This causes the bolt 60 to reciprocate within chamber C in unison with the reciprocation of the ram rod 36 and h-tube 39 within chamber B. The bolt retention pin 64 proximal end 88 extends through a groove (not shown) formed in the chamber C, thereby allowing it to protrude from the exterior of the gun body 17. By grasping the proximal end 88 and pulling the retention pin 64 away from the gun body 17, the distal end 87 of the retention pin 64 may be disengaged from the h-tube 39, thereby allowing the bolt 60 to be freely slid out of the back end of chamber C. This allows the bolt to be removed quickly and easily. The retention pin 64 has a groove 89 built into it with a divot 90 at each end of the groove 89. A ball bearing 65 rides in the groove 89 and is held in place by the force of a spring 66. The ball bearing 65 can only move between the two divots 90 in the groove 89. A stop 67 in the form of a turned down nose of a set screw keeps the ball bearing 65 from backing out of the groove 89. This system allows the retention pin 64 to be pulled up but not out of the bolt 60. Pulling the retention pin 64 toward the proximal end 88 causes the ball bearing 65 to move to the second divot 90, freeing the retention pin 64 of the h-tube 39, allowing disassembly of the bolt from the chamber C. Installation of the bolt 60 back into the gun 11 follows the reverse procedure.

With reference to FIGS. 1*a–e* and 10, the solenoid system of the paintball gun 11 of the present invention is illustrated. Regulated air from the pneumatic regulator 25 flows through air passages 80 and 68 inside the bottom of the gun body 17 to the electronic solenoids 69 and 70. Air passages 68 and 80 are coupled by a tube (not shown) exterior of the gun body 17. Electronic solenoids 69 and 70 are 4-way valves manufactured by MAC Valves in Michigan. They are a low voltage, low wattage valve. The model number is 44B-AAA-GDSA-1BA with a special modification. The air ports are normally located on the sides of the valve with one input port, 2 output ports and 2 exhaust ports. The valves were modified by adding 1 new inlet and 2 new outlet ports to the large flat surfaces of the valve body (see FIG. 10). The existing inlet and output ports are plugged with set screws while the exhaust ports are left open to allow the valve to vent the air. The solenoids 69, 70 direct regulated air to the pneumatic ram, pulling the bolt 60 forward and sending air to the hammer system, pushing the hammer 41 back to the ready-to-fire position. The gun 11 includes and an on-off switch 75 that allows the user of the gun 11 to turn the game 11 off in order to extend the battery 72 life. The batteries 72 are preferably housed within the grip frame 12. The grip frame cover plate 76 covers the two solenoid valves 69, 70 and forms a storage compartment 76 for the electronic circuit board 71 that controls the guns functions.

Referring once again to FIGS. 1*a* and 3, the paintball gun 11 is shown with all components at rest and in the ready-to-fire position. At rest, air pressure pushes the hammer 41 back, compressing the hammer spring 49 inside the hammer tube 43, which is housed inside chamber A of the main gun body 17. In chamber B, air pressure pushes the ram 36 forward, keeping the bolt 60 forward. This keeps the paintball P in chamber C. Air pressure also pushes the regulator plunger 28 against the regulator set 29, sealing the high pressure air from the low pressure side 33 of the regulator. Air pressure also keeps the valve stem 55 sealed against the valve body 52, thereby keeping the air inside the valve chamber 56.

With reference to FIGS. 1*b* and 3, when the trigger 14 is pulled and activates the microswitch 73, the electronic control circuit 71 activates solenoid 70, releasing the air from the front of the hammer 41, thereby allowing spring 49 to push the hammer 41 at a high speed. Hammer 41 hits the valve stem 55, opening the valve 52 and releasing air from the valve chamber 56 into the slanted inlet hole 61 of the bolt 60. As the air exits the conical outlet hole 63, the paintball P is pushed down the barrel 13.

With reference to FIGS. 1*c* and 3, the circuit board 71 keeps the solenoid 70 turned on for a predetermined amount of time, then turns the solenoid 70 off. This returns the air to the front of the hammer 41, pushing the hammer to its ready-to-fire position compressing hammer spring 49.

Figure 1E:
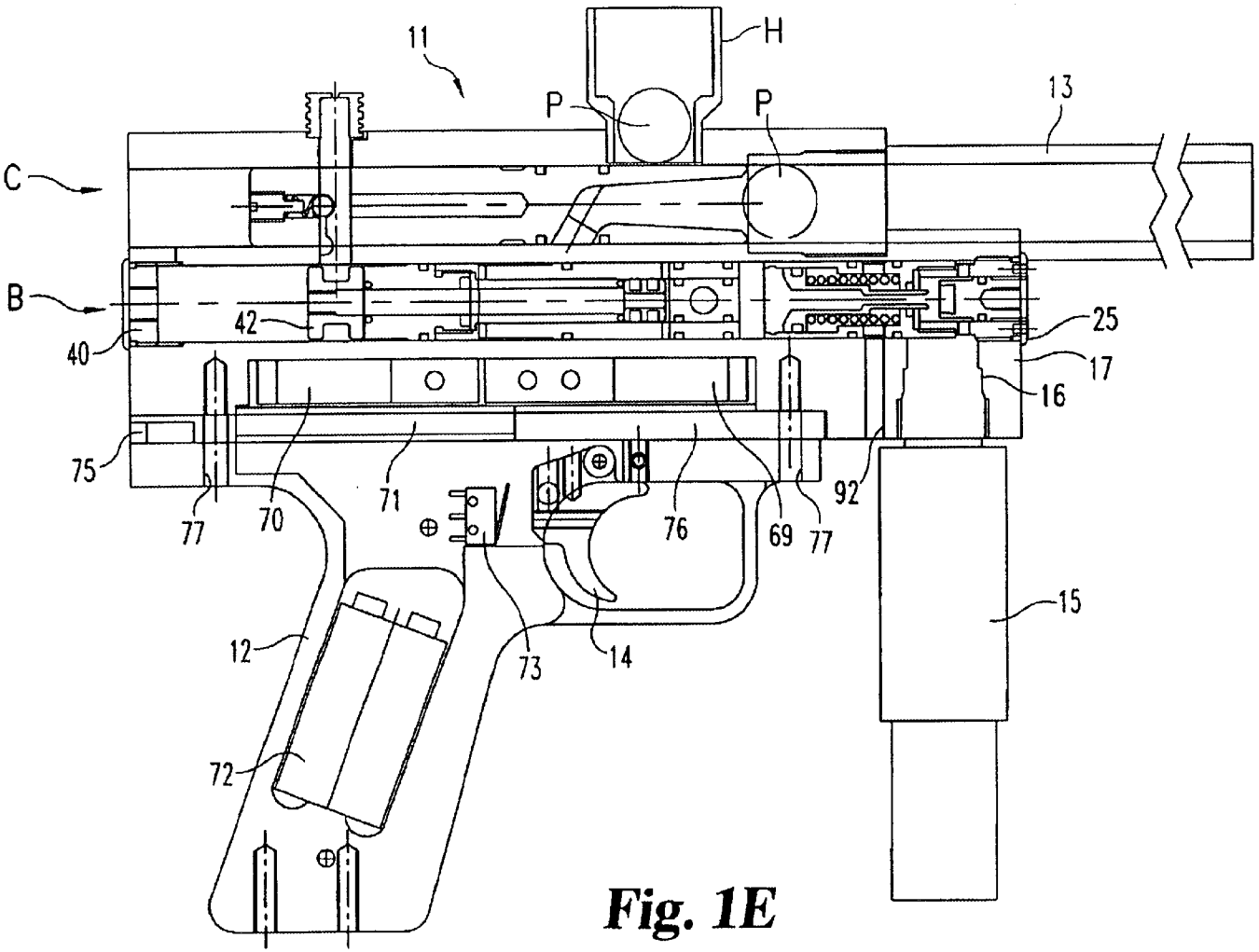
FIG. 1*e* is a right side view of the gun of FIGS. 1*a–d* with bolt closed and with ball in chamber ready to fire again.

With reference to FIGS. 1*d* and 3, at a predetermined time interval after hammer solenoid 70 is turned off, the electronic circuit board 71 turns on the bolt solenoid 69. Turning on the bolt solenoid 69 releases air from behind the ram 36 and supplies air to the front side of the ram 36. This in turn pushes the ram 36 backwards, pulling the bolt 60 back to its rearward position. This allows another paintball P to drop into the chamber C. The electronic circuit board 71 waits a predetermined amount of time so that the paintball P can drop into the breach and then turns off the solenoid 69, storing energy from the solenoid 69 on the circuit board 71 and allowing the air to vent out of the front side of the ram 36 and returning air to the back side of the ram 36. This air pushes the ram 36 back to its rest position, which in turn pulls bolt 60 forward to close the breach, thereby sealing the paintball P inside chamber C. In FIG. 1*e,* the paintball gun 11 has returned to the ready-to-fire state of FIG. 1*a*.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A pneumatic paintball gun, comprising:

a gun body having first, second and third bores formed at least partially therethrough;

wherein the first, second and third bores have respective first, second and third longitudinal axes;

wherein the first, second and third longitudinal axes are parallel to one another;

wherein lines drawn connecting the first, second and third axes in a plane perpendicularly intersecting the first, second and third axes form a triangle;

a source of gas at a first pressure;

a bolt slidable within said first bore;

a pressure regulator received within said second bore, said pressure regulator receiving gas at the first pressure and providing gas at a second, reduced pressure;

a chamber defined within said third bore receiving gas at the second pressure;

a member received within said third bore and slidable between first and second positions, wherein the first position seals gas within said chamber, and the second position releases the gas to the first bore.

2. The pneumatic paintball gun of claim 1, wherein a paintball gun is expelled from the first bore, and the first bore is above the second and third bores when the gun is held by a use in its normal firing position.

3. The pneumatic paintball gun of claim 1 wherein said second bore includes a slidable rod for actuating said bolt.

4. The pneumatic paintball gun of claim 1 wherein one of said bores includes an external opening, and which further comprises a pneumatic assembly accessible through the external opening and having a first member slidably coupled to a second member, an externally accessible third member covering said external opening and being repeatedly removable from the external opening, wherein removal of said third member permits said pneumatic assembly to be removed from the one said bore, and said first member and said second member being adapted and configured to be retained together after removal.

5. The pneumatic paintball gun of claim 1 which further comprises a rod for actuating said bolt, and a pin slidable between a first position coupling said rod to said bolt and a second position uncoupling said rod from said bolt.

6. The pneumatic paintball gun of claim 1 wherein said pressure regulator is a low pressure regulator, said source of gas is a high pressure regulator providing gas at the first pressure to said low pressure regulator, and which further comprises a reservoir of gas at a third pressure higher than the first pressure, said high pressure regulator receiving gas at the third pressure.

7. A pneumatic gun for shooting a paintball, comprising:

a gun body having first, second and third bores, said first, second and third bores having respective first, second and third longitudinal axes, the first, second and third longitudinal axes being parallel to one another and spaced apart from one another;

a bolt, said bolt being slidable within said first bore;

a rod for attaching said bolt, said rod being slidable within said second bore; and a hammer for releasing compressed air into said first bore, said hammer being slidable within said third bore.

8. The pneumatic gun of claim 7 which further comprises a pin slidable between first and second positions, wherein sliding said pin to the first position couples said bolt to said rod and sliding said pin to the second position uncouples said bolt from said rod.

9. The pneumatic gun of claim 7 wherein lines drawn connecting the first, second and third axes in a plane perpendicularly intersecting the first, second and third axes form a triangle.

10. The pneumatic gun of claim 7 wherein said first bore receives a paintball.

11. The pneumatic gun of claim 7 which further comprises a first pressure regulator providing compressed air to the paintball gun at a first predetermined pressure, and a second pressure regulator receiving compressed air at the first predetermined pressure and providing air to said first bore at a second predetermined pressure lower than the first predetermined pressure.

12. A pneumatic paintball gun, comprising:

a source of compressed air;

a gun body having a bore with an external opening;

a pneumatic assembly in fluid communication with said source, said pneumatic assembly having a first member slidably coupled to a second member, said pneumatic assembly being located within said bore; and a third member coupled to said bore and covering said opening, said third member being externally accessible and repeatedly removable;

wherein movement of said third member permits said pneumatic assembly to be removed from said bore, said first member and said second member are retained together after removal from said bore, said third member is threadably coupled to said bore, and said pneumatic assembly is a cartridge valve.

13. The pneumatic paintball gun of claim 12 wherein said pneumatic assembly includes a pneumatic regulator.

14. The pneumatic paintball gun of claim 12 wherein said pneumatic assembly includes a pneumatic ram.

15. The pneumatic paintball gun of claim 12 wherein said pneumatic assembly includes a pneumatic hammer.

16. A pneumatic paintball gun, comprising:

a source of compressed air;

a gun body having a bore with an external opening;

a pneumatic assembly in fluid communication with said source, said pneumatic assembly having a first member slidably coupled to a second member, said pneumatic assembly being located within said bore; and a third member coupled to said bore and covering said opening, said third member being externally accessible and repeatedly removable;

wherein removal of said third member permits said pneumatic assembly to be removed from said bore, and said first member and said second member are retained together after removal from said bore;

and which further comprises a first pressure regulator providing compressed air to the paintball gun at a first predetermined pressure, and a second pressure regulator receiving compressed air at the first predetermined pressure and providing air to said gun at a second predetermined pressure lower than the first predetermined pressure.

17. The pneumatic paintball gun of claim 16 wherein said pneumatic assembly includes a pneumatic regulator and said third member is threadably coupled to said bore.

18. The pneumatic paintball gun of claim 16 wherein said pneumatic assembly includes a pneumatic ram and said third member is threadably coupled to said bore.

19. The pneumatic paintball gun of claim 16 wherein said pneumatic assembly includes a pneumatic hammer and said third member is threadably coupled to said bore.

* * * * *